United States Patent [19]

Magruder et al.

[11] Patent Number: 4,682,557

[45] Date of Patent: Jul. 28, 1987

[54] SAILING WING

[76] Inventors: Thomas A. Magruder, 5932 Jordan Ave., El Cerrito, Calif. 94530; Robert L. Crowell, Rte. 6, P.O. Box 473-B, Boone, N.C. 28607

[21] Appl. No.: 817,846

[22] PCT Filed: Dec. 5, 1985

[86] PCT No.: PCT/US85/02407

§ 371 Date: Dec. 5, 1985

§ 102(e) Date: Dec. 5, 1985

Related U.S. Application Data

[63] Continuation-in-part of Ser. No. 661,782, Oct. 17, 1984, abandoned.

[51] Int. Cl.[4] ..... B63H 9/04

[52] U.S. Cl. ..... 114/39; 114/91; 114/98

[58] Field of Search ..... 114/39, 39.2, 102, 103, 114/91, 97–99, 272, 273; 280/810; 244/DIG. 1.1–1.4

[56] References Cited

U.S. PATENT DOCUMENTS

| | | | |
|---|---|---|---|
| 2,329,220 | 9/1943 | Rummler | 114/39 |
| 4,198,019 | 4/1980 | Linczmajer | 244/DIG. 1.3 |
| 4,382,417 | 5/1983 | Talve | 114/39.2 X |
| 4,458,859 | 7/1984 | Ganev | 114/39.2 X |
| 4,610,212 | 9/1986 | Petrovich | 114/39 |

FOREIGN PATENT DOCUMENTS

| | | | |
|---|---|---|---|
| 15875 | 9/1980 | European Pat. Off. | 114/39.1 |
| 0081003 | 6/1983 | European Pat. Off. | 114/39.2 |
| WO82/03053 | 9/1982 | PCT Int'l. Appl. | 114/39.2 |
| WO86/02330 | 4/1986 | PCT Int'l. Appl. | 114/103 |
| 1184914 | 3/1970 | United Kingdom | 114/102 |
| 2122561 | 1/1984 | United Kingdom | 114/39.2 |

*Primary Examiner*—Sherman D. Basinger

*Attorney, Agent, or Firm*—Limbach, Limbach & Sutton

[57] ABSTRACT

A sailboard with a wing-like sail pivoted to the top of a mast for free roll motion but constrained against pitch. The wing may have a leading edge flap. The wing is made from a sail stretched on a space frame which is demountable for compact storage.

12 Claims, 7 Drawing Figures

SAILING WING

RELATED APPLICATIONS

This application is a continuation in part of our copending application Ser. No. 06/661,782 filed Oct. 17, 1984, now abandoned.

BACKGROUND OF INVENTION

This invention relates generally to sailboards and particularly to an improved form of sailboard propelled by a wing structure. While the invention is primarily designed for use in sailboards, the wing structure can be mounted upon land sailing hulls and upon more conventional hulls with stayed masts such as catamarans.

In the evolution of sailboards since the invention of the Schweitzer U.S. Pat. No. RE 31,167, a number of proposals have been made for propelling a sailboard with a wing like sail. One such proposal in German patent application No. DE 3240203 published 5-3-84 employs a wing like sail which is held by the sailor while the sailor is tethered to the sailboard. In European patent application No. 0015875 published 9/16/80, a wing like sail is mounted on the top of a mast on a hull for universal pivotal motion around the top of the mast, and a similar concept is disclosed in French Pat. No. 2498554. Similar concepts have been proposed for mounting a wing like sail on sailboards in U.S. Pat. No. 4,458,859 and PCT application No. W082/03053 published 9-16-82 where wing like members are connected to the top of a mast on a sailboard for universal movement with respect to the mast.

While it is very desirable to be able to employ a wing like sail on a sailboard for a number of reasons, the proposals indicated in the publications mentioned above have had serious design flaws due primarily to the fact that physical control of the wing like sail during sailing operations is so awkward and difficult that sailboards equipped with these devices are relatively uncontrollable.

SUMMARY OF INVENTION

In accordance with our invention we have designed a wing like sailing craft in which effective sailing control is obtained by mounting the wing at the top of a mast with a hinge by which the wing can be pivoted about a generally chordwise "roll" axis between port tack and starboard tack positions through an intermediate lift position. At the same time the structure is constructed so that the wing is constrained against pivotal movement with respect to the mast about the spanwise "pitch" axis of the wing.

As indicated above, the wing structure of this invention may be employed upon land sailing craft and sailing hulls with stayed masts, but preferably the invention is used on a sailboard where the bottom of the mast is connected to a surfboard by a universal joint which permits the mast to be pivoted fore and aft and side to side and rotated about the axis of the mast.

When a sailboard is constructed in this manner, the wing can be pivoted about its hinge to the starboard side of the sailboard when the board is sailed on a port tack, and the wing can be pivoted about the hinge to the port side of the sailboard when the board is sailed on a starboard tack. With the sail constrained against pivoting on the mast in a fore and aft direction, that is about the "pitch" axis parallel to the span of the wing, the sailboard can be controlled in either of the port tack or starboard tack conditions in a manner much like a conventional sailboard.

At the same time a wing board constructed in accordance with our invention may be manipulated much easier between port and starboard tacks since the sailor can move between port and starboard tacks by swinging the wing about its hinge instead of moving his body around the mast or around a sail. In the intermediate position between maximum port tack and starboard tack positions, the wing passes through a high lift position with its lift directed generally vertically where the sailor can use the lift of the sail to make high speed, low drag turns and aerobatic where the sailor and board become airborne.

It can be confusing to speak of the roll, pitch and yaw, because the terms may have different meanings depending upon what they relate to. Thus, when the wing has been rolled about its longitudinal axis of symmetry to a maximum port tack position, movement of the wing in its pitch direction about its spanwise axis may produce a rudder effect normally associated with yaw, and pitching the wing fore and aft with respect to the sailboard is a yaw motion of the wing with respect to its longitudinal axis of symmetry. For this reason we will use the terms in relation to the roll, pitch and yaw of the wing as indicated by the axes in FIG. 2.

The improved stability of our wing-board is obtained in large part because the constraint of the hinge joint connecting the wing to the mast, preventing "pitch" of the wing, operates to lock the wing and mast together against forces moving the wing fore or aft. Thus, with the wing rolled to a tack position, the lever arm of the mast provides fine control of the fore and aft position of the wing as in a conventional sailboard. Similarly, with the wing in its intermediate high lift position, the lever arm of the mast provides fine control of the angle of attack of the wing.

The wing of our wing board is constructed with a dihedral angle of between 90 and 180 degrees, and preferably between 90 and 160 degrees. Preferably the wing in our wing board is constructed with a dihedral angle about a 150° with the two wings inclined to each other by 30°. A sailboard constructed in this manner has not only the aerodynamic stability of such a dihedral wing but also a greatly improved facility for what is known in sailboarding "water starts."

Thus, with a dihedral angle of 30° between the two halves of the wing, the downwind half of the wing may be in the air when the upwind half of the wing is pushed up into the air so the entire wing is able to generate lift. Put another way while the upwind half of the wing is in the air providing lift for a water start, the downwind half of the wing is not buried in the water producing drag.

Aside from the improved aerodynamic features of our invention, the sailing wing of our invention is constructed in an efficient mechanical way whereby a chordwise body strut carrying the hinge connection for the mast is removably connected through a central support piece to a pair of wing struts where the body strut and wing struts may be made of simple straight tubing and the central support piece may be built with precision incorporating a selected dihedral angle. Control support bars on opposite sides of the body strut are connected to the wing struts for swinging the wing about its hinge, and the control supports may be disconnected from the wing struts and the wing struts disconnected from the central support piece to permit the entire structure to be mounted with its elongated members parallel to each other for compact shipping.

Finally, a variety of adjustments are provided in a very efficient manner permitting the wing sail to be adapted to different size sails, and to be mounted upon different masts for use on different sailing hulls.

In a preferred form of our wing we provide a retractable, and removable, leading edge flap or jib providing increased lift through increased chord and camber.

DETAILED DRAWINGS

These and other features of the invention will become apparent from the following description read in conjunction with the attached drawing in which.

Figure 1:
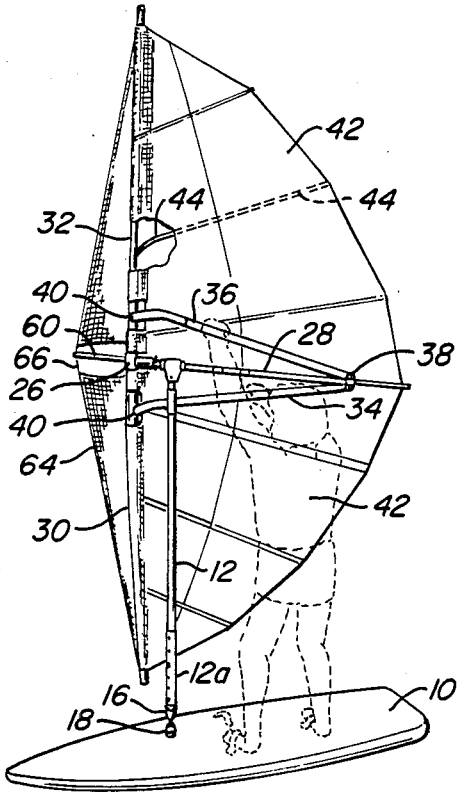
FIG. 1 is a perspective view of a sailboard constructed in accordance with the principles of this invention and showing our sailing wing pivoted to its port tack position with the wing on the starboard side of the mast.
Figure 6A:
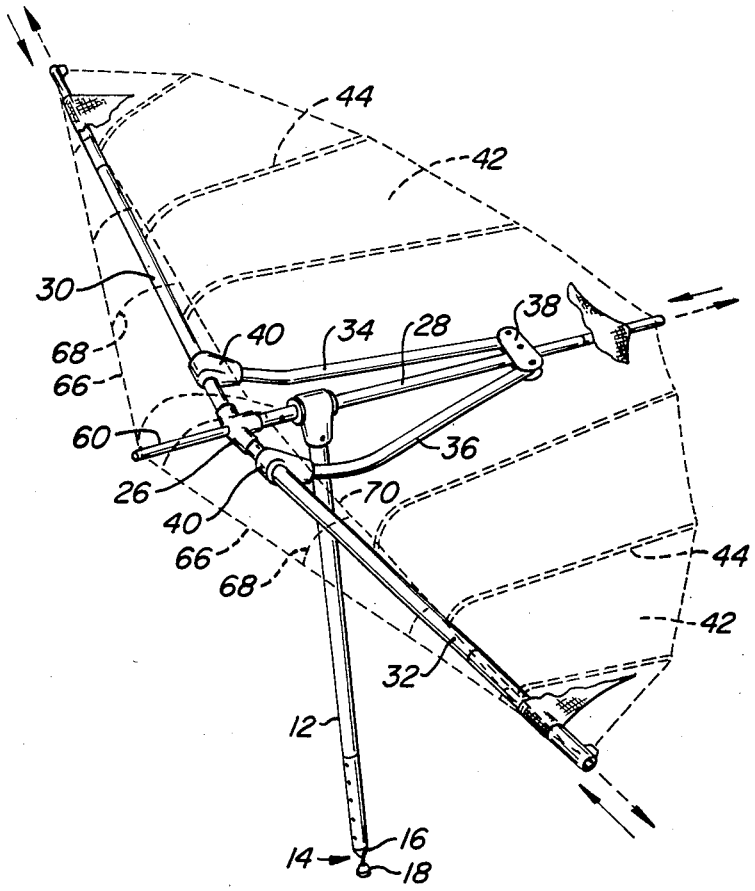
Figure 6B:
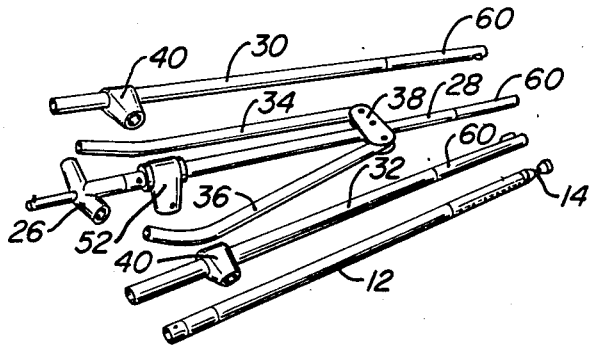

FIG. 6A is a perspective view of the support structure of the wing and mast of FIG. 1 with the structure held together by the tensioning means which stretch the sail over the structure, and FIG. 6B is a perspective view of the structural elements of FIG. 6A as they are dissembled for shipment in which the mast is removed from the hinge, and the remaining components of the structural support are disconnected from each other but retained together in the sail.

Figure 2:
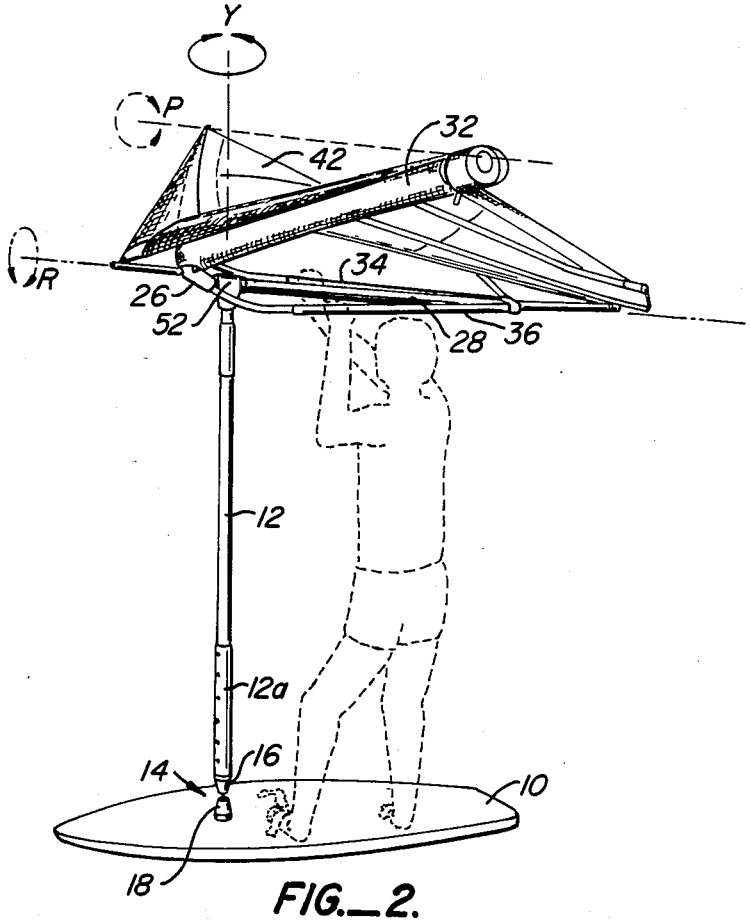
FIG. 2 is a perspective view similar to FIG. 1 showing the wing pivoted about the hinge to the intermediate lift position.

The wing sail of our invention provides a very unique ability to move between port and starboard conditions with the wing overhead as shown in FIG. 2, but even more importantly in this condition of the wing in FIG. 2 the wing provides high lift forces which are directed in a purely vertical direction to permit the sailor to become airborne and actually fly the wing board between port and starboard tacks somewhat in the manner of a hang glider.

DETAILED DESCRIPTION

Referring now in detail to the drawings the preferred wing board of our invention includes a surfboard hull 10 which may be of conventional design but which preferably is constructed as light as possible. The hull 10 may be of sufficiently small weight and volume that its buoyancy will not support the weight of the sailor, but after the sailor has started with a water start the combined lift of the sail, buoyancy and planeing forces of the hull will support the sailor above the water.

A mast 12 is connected to the hull 10 by a universal joint 14 in which upper and lower members 16 and 18 are connected by a flexible rod 20. The lower member 18 is held in the board 10 by a clamp 22 in a groove 24 (preferably in a fixture above the board) which permits rotation of the mast with respect to the hull, and the lower portion of the mast is provided with a telescopic extension 12A with conventional detents 12B to permit the height of the mast to be adjusted.

The wing may be constructed of a rigid or semirigid material such as light weight expanded plastic, but we prefer to construct the wing with the conventional techniques used in sailboards and hang gliders where a sail or skin is stretched over a space frame.

The structural support for the wing includes a central support piece 26 connected to a body strut 28 which extends in a chordwise direction. The central support piece 26 has a pair of sockets extending in spanwise directions and inclined to each other at a dihedral angle as illustrated in FIG. 2, and a pair of wing struts 30 and 32 are fitted into the central support piece 26 to form the structural wings. A pair of control supports 34 and 36 on opposite sides of the body strut 28 are pivotally connected to a bracket 38 on the body strut with the free ends of the control supports received in sockets 40 on the wing struts 30 and 32.

Figure 5:
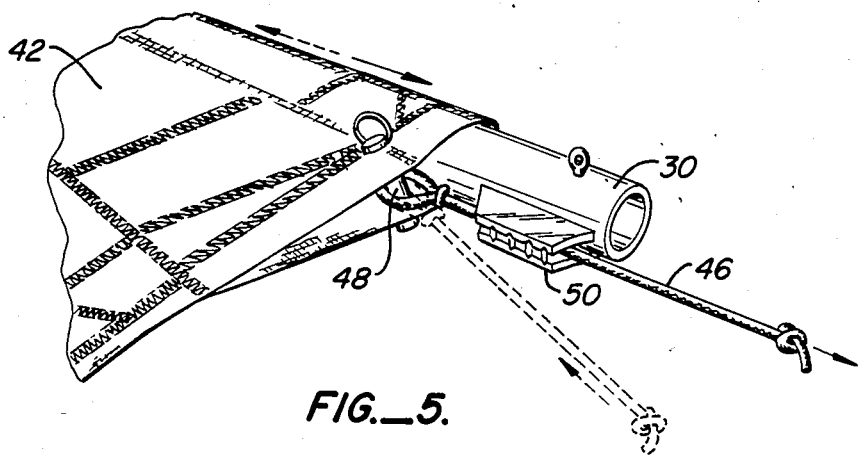
FIG. 5 is a perspective view of a portion of the tensioning means by which the sail is stretched on the wing support structure.

The wing struts 30 and 32 are mounted in pockets in the leading edge of a sail 42 as illustrated in FIG. 5 together with conventional ribs or ribs 44 like those used in hang glider sails which give the wing a highly cambered shape.

Suitable tensioning devices are provided for connecting the sail 42 to the ends of the wing struts 30 and 32 and the body strut 38 to stretch the sail in a substantially rigid airfoil shape. One suitable mechanism for tensioning the sail is illustrated in FIG. 5 where a rope 46 is connected to the sail by a pin 48 and held to the wing strut 30 by a jam cleat 50. While a simple connection is illustrated herein it is preferable to employ a multi-part block and tackle between the pin 48 and jam cleat 50 to facilitate tensioning of the sail. While the wing struts 30 and 32, the body strut 28, and the control supports 34 and 36 may be disconnected from each other to the position illustrated in FIG. 6B, they are held rigidly together in position of FIG. 6A by the tension of the sail.

Figure 4:
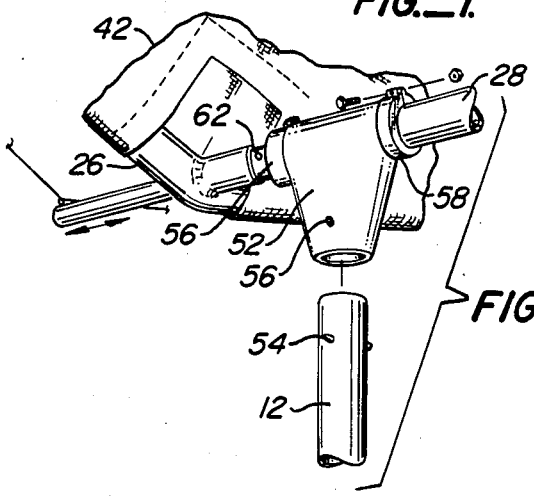
FIG. 4 is a detailed perspective view of the hinge between the mast and body strut.
Figure 3:
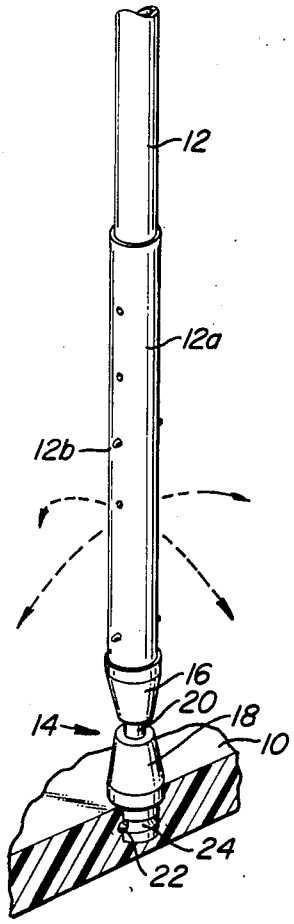
FIG. 3 is a detailed view partially in section of the base of the mast of the structure of FIG. 1.

With reference to FIG. 4, a hinge body 52 is provided at the top of the mast 12 connected to the mast by conventional detents 54 which fit holes 56. The hinge body 52 contains a central bore which loosely receives the body strut 28 permitting the hinge body 52 to pivot around the axis of the body 28, and clamp rings 56 and 58 are provided at opposite ends of the body 52 to clamp the hinge body 52 at a location along the length of the body strut 28 aft of the leading edge of the sail at a position selected by the sailor to provide the most convenient control considering the strength of the wind and the location at which the sailor wishes to grasp the control supports 34 and 36.

As illustrated in FIG. 1, the support for the wing in this manner permits it to be rolled about a central symmetrical "roll" axis R by pivoting the wing at the mast while the wing is constrained against motion with respect to the mast about the spanwise "pitch" axis P. The wing can be trimmed in all directions, roll, pitch and yaw by movement between the mast and board at the lower joint 14.

It will be apparent that the control supports 34 and 36 which are located between the sail 42 and the hull 10 provide a stop limiting the maximum roll of the wing in either the port tack or starboard tack directions. Thus, while the sailor can adjust the wing to any preferred inclination he desires thereby limiting heeling forces and permitting him to stand more erect than is possible with a conventional sailboard, the sailor can rotate the wing all of the way to the position where the starboard side control support 34 contacts the mast 12 and thereafter merely holding the support 34, the wing board can be sailed much as a conventional sailboard.

As illustrated in FIG. 1, the wing of our invention can also include a retractable and removable leading edge flap or jib sail depending upon whether it is viewed as an aircraft or sailboat. The flap is provided by a strut 60 telescopically extended from the body strut 28 and held in place by detents 62. A jib sail 64 is supported in front of the wing leading edge by lines 66 stretched between the strut 60 and the tips of the wing struts 30 & 32.

The jib is preferably provided with a pocket at its leading edge receiving the line 66 and ribs 68 giving it an aerodynamic shape. The trailing edge of the jib may be controlled by a line 70 stretched between the wingtips through a pocket in the jib trailing edge and a fabric loop on the wing, and suitable fastening material, Velcro for instance, may be provided to hold the leading edge flap faired on the wing leading edge when the lines 66 & 70 are released.

A number of additional features and adjustments may be provided in the structure for instance removable sections 60 on the body and wing struts may be employed as shown in FIG. 6B to adapt the structure to different size sails.

We claim:

1. A sailing apparatus comprising:

a hull adapted to support a sailor, a wing having an axis of symmetry generally aligned with a direction of wing flight with the wing movable with respect to the axis in roll, pitch and yaw directions, a mast, a lower joint connecting the mast to the hull for pivotal movement of the mast with respect to the hull in the pitch and roll directions, and an upper joint connecting the wing to the mast for pivotal movement of the wing with respect to the mast in the roll direction but constrained against relative movement in the pitch direction with respect to the mast whereby the wing can be rolled between port and starboard tack positions through an intermediate life position whereby the hull can be lifted from the water, one of the joints providing relative movement in the yaw direction.

2. The sailing apparatus of claim 1 in which the lower joint is a universal joint permitting relative motion between the mast and hull in the roll and pitch directions, but transmitting tension and compression forces from the mast to the hull, and the mast forms the sole connection between the wing and hull.

3. The sailing apparatus of claim 2 in which the hull is a surf board adapted to support a sailor when the hull is moving through the water.

4. The sailing apparatus of claim 3 in which the upper joint is further constrained to prevent pivotal motion in the roll direction greater than 180 degrees whereby the wing can be rolled with respect to the mast between maximum port tack and starboard tack positions through an intermediate lift position, and the wing and mast roll as a unit in the maximum port tack and starboard tack positions.

5. The sailing apparatus of claim 4 having manual control supports on opposite sides of the axis of symmetry operable by the sailor to roll the wing.

6. The sailing apparatus of claim 4 in which control supports are mounted on a generally rigid support of the wing between the wing and the hull and positioned to engage the mast and limit pivotal motion between the wing and mast in maximum port and starboard tack positions.

7. The sailing apparatus of claim 6 in which said wing has a dihedral angle between 90 and 160 degrees.

8. The sailing apparatus of claim 1 in which the wing comprises:

a sail, a generally rigid support, and means for stretching the sail on the support.

9. The sailing apparatus of claim 8 in which said wing has a retractable leading edge flap comprising:

a strut telescopically extended from said generally rigid support generally along said axis of symmetry a jib sail, and means stretching the jib sail between the telescopically extended strut and the tips of the wing.

10. Sailing apparatus comprising:

a surf board hull adapted to support a sailor when the hull is moving through the water, a mast connected to the hull by means of a universal joint permitting universal pivoting of the mast with respect to the hull and extending upwardly therefrom with the mast having an upper end, a wing having an axis of symmetry generally aligned with a direction of wing flight with the wing movable with respect to the axis in roll, pitch and yaw directions and having:

a sail, a generally rigid support including a body strut generally parallel to the axis of symmetry and wing struts connected to the body strut and extending in spanwise directions and inclined to each other by a dihedryl angle of about 180 to 90 degrees, and means for stretching the sail on the support including battons supporting the sail in a cambered shape, a hinge member mounted on the body strut at a location aft of the wing leading edge for pivotal motion about the body strut with the hinge member connected to the mast and constrained against pivotal motion in the pitch direction with respect to the mast whereby the wing can be rolled between port and starboard tack positions through an intermediate lift position whereby the hull can be lifted from the water, and control supports connected to the body strut on opposite sides of the body strut and connected to the wing struts for swinging the wing on the hinge member between port tack and starboard tack positions through an intermediate lift position.

11. The sailing apparatus of claim 10 in which the wing struts are detachably connected to the body strut, and the control supports are pivotally connected to the body strut on opposite sides of the body strut and detachably connected to the wing struts for swinging the wing on the hinge member between port tack and starboard tack positions through an intermediate lift position while permitting collapsing the apparatus to a shipping condition with the wing struts, body strut and control supports all generally parallel to each other.

12. A sailing wing having an aerodynamic leading edge, generally symmetrical wing tips and a spanwise axis extending between the wing tips with the wing comprising:

a sail, a generally rigid support including a body strut extending in a chordwise direction and wing struts connected to the body strut and extending in spanwise directions and inclined to each other by a dihedral angle of about 180 to 90 degrees, means for stretching the sail on the support including battens supporting the sail in a cambered shape, a hinge member mounted on the body strut at a location aft of the wing leading edge for pivotal motion about the body strut and constrained against pivotal motion with respect to the body strut about the spanwise axis with the hinge member adapted to be connected to a mast of a sailing craft, control supports connected to the body strut on opposite sides of the body strut and connected to the wing struts for swinging the wing on the hinge member between port tack and starboard tack positions through an intermediate lift position, and a retractable leading edge flap comprising:

a strut telescopically extended from said body strut ahead of the leading edge, a jib sail, and means stretching the jib sail between the telescopically extended strut and the wing tips.

* * * * *